US005188804A

United States Patent [19]

Pace et al.

[11] Patent Number: 5,188,804

[45] Date of Patent: Feb. 23, 1993

[54] REGENERATIVE BED INCINERATOR AND METHOD OF OPERATING SAME

[75] Inventors: Darr C. Pace; Craig E. Bayer; Mark T. Casagrande, all of Wellsville; Craig R. Johnson, Cuba; Danny K. Hall; Andrew W. Nolan, both of Wellsville, all of N.Y.

[73] Assignee: The Air Preheater Company, Inc., Wellsville, N.Y.

[21] Appl. No.: 456,896

[22] Filed: Dec. 26, 1989

[51] Int. Cl.[5] ..... B01D 53/36

[52] U.S. Cl. ..... 422/111; 110/245; 110/345; 422/177; 422/178; 431/5; 431/170

[58] Field of Search ..... 422/111, 177, 178; 431/5, 170; 110/245, 345

[56] References Cited

U.S. PATENT DOCUMENTS 3,870,474 3/1975 Houston ..... 23/277 C 4,101,632 7/1978 Lamberti et al. ..... 110/345

4,650,414 3/1987 Grenfell ..... 431/5

4,741,690 5/1988 Heed ..... 431/7

OTHER PUBLICATIONS

Perry, John H, Editor, "Chemical Engineering Handbook", 3rd Edition, 1950, pp. 1625 and 1626.

*Primary Examiner*—Robert J. Warden

*Assistant Examiner*—Timothy M. McMahon

*Attorney, Agent, or Firm*—Paul J. Lerner

[57] ABSTRACT

In a regenerative bed incinerator 10 of type wherein the direction of gas flow through the bed 14 is periodically switched via a gas switching valve 30, a controller 80 is provided to periodically activate the gas switching valve 30 to reverse the direction of gas flow through the bed 14 in response to the temperature of the cooled incinerated process exhaust gases 5 as measured by gas sensing means 90.

3 Claims, 1 Drawing Sheet

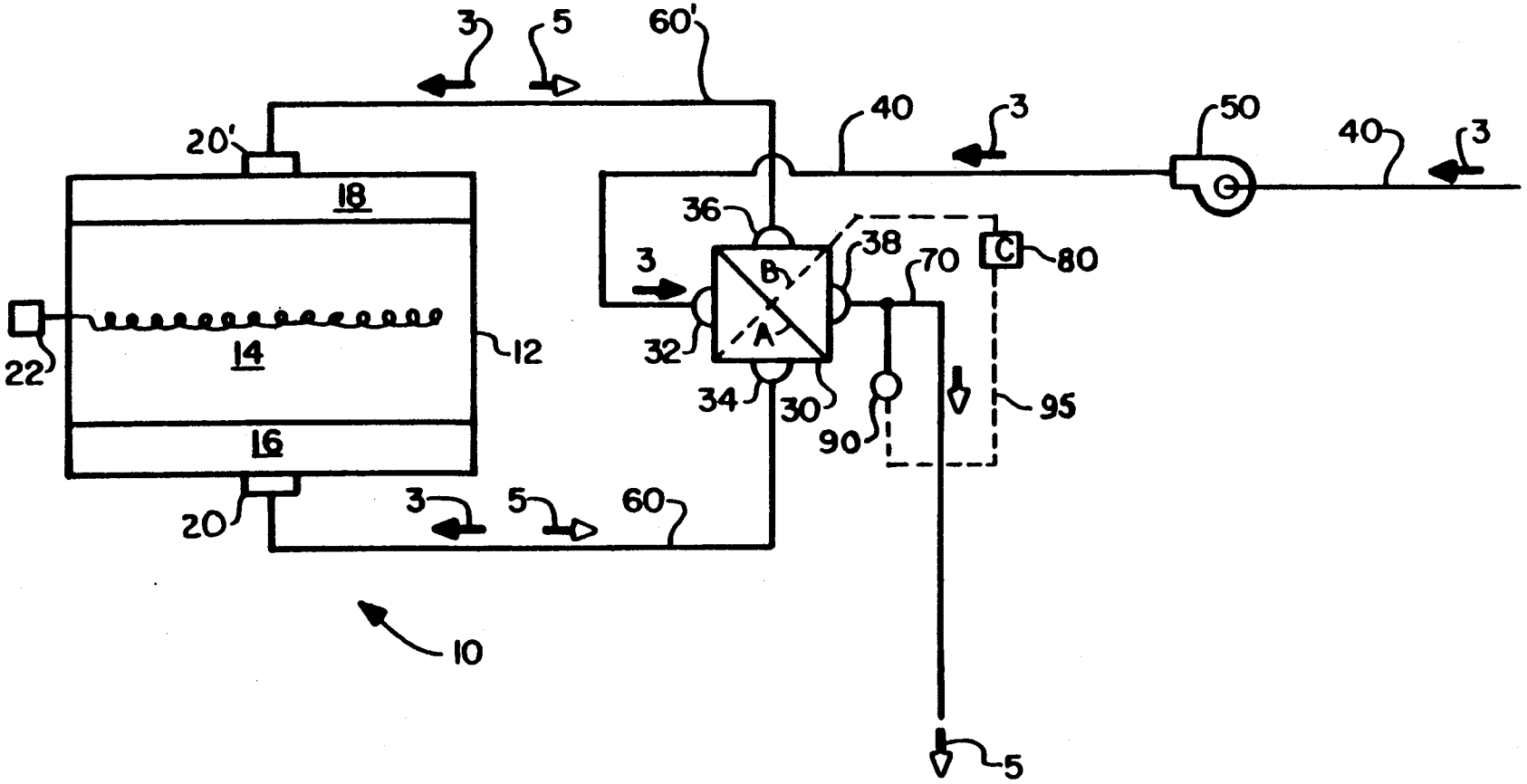
3
40
50
3
40
80
95
5
70
38
90
30
B
A
36
34
60'
3
32
60
5
5
12
3
3
10
18
14
16
20'
20
22

REGENERATIVE BED INCINERATOR AND METHOD OF OPERATING SAME

BACKGROUND OF THE INVENTION

The present invention relates generally to the regenerative incineration of solvents and other hydrocarbons in exhaust streams, and more particularly, to a regenerative bed, switching flow-type incinerator for processing waste gas/exhaust air with combustible hydrocarbons contained therein.

Many manufacturing operations produce waste gases or exhaust air which include environmentally objectionable contaminants, generally combustible fumes such as solvents and other hydrocarbon substances, e.g., gasoline vapors, paint fumes, chlorinated hydrocarbons. The most common method of eliminating such combustible fumes prior to emitting the exhaust gases to the atmosphere is to incinerate the waste gas or exhaust air stream.

One method of incinerating the contaminants is to pass the waste gas or exhaust air stream through a fume incinerator prior to venting the waste gas or exhaust air stream into the atmosphere. An example of a suitable fume incinerator for incinerating combustible fumes in an oxygen bearing process exhaust stream is disclosed in U.S. Pat. No. 4,444,735. In such a fume incinerator, the process gas stream is passed through a flame front established by burning a fossil fuel, typically natural gas or fuel oil, in a burner assembly disposed within the incinerator. In order to ensure complete incineration of the combustible contaminants, all of the process exhaust stream must pass through the flame front and adequate residence time must be provided. Additionally, it is desirable to preheat the process exhaust stream prior to passing it through the flame front so as to increase the combustion efficiency. Of course, the cost of the heat exchanger to effectuate such preheating, in addition to the cost of the auxiliary fuel, render such fume incinerators relatively expensive.

Another type of incinerator commonly used for incinerating contaminants in process exhaust streams is the multiple-bed, fossil fuel-fired regenerative incinerator, such as, for example, the multiple-bed regenerative incinerators disclosed in U.S. Pat. Nos. 3,870,474 and 4,741,690. In the typical multiple-bed systems of this type, two or more regenerative beds of heat-accumulating and heat-transferring material are disposed about a central combustion chamber equipped with a fossil fuel-fired burner. The process exhaust stream to be incinerated is passed through a first bed, thence into the central combustion chamber for incineration in the flame produced by firing auxiliary fuel therein, and thence discharged through a second bed. As the incinerated process exhaust stream passes through the second bed, it loses heat to the material making up the bed. After a predetermined interval, the direction of gas flow through the system is reversed such that the incoming process exhaust stream enters the system through the second bed, wherein the incoming process exhaust stream is preheated prior to entering the central combustion chamber, and discharges through the first bed. By periodically reversing the direction of gas flow, the incoming process exhaust stream is preheated by absorbing heat recovered from the previously incinerated process exhaust stream, thereby reducing fuel composition.

A somewhat more economical method of incinerating combustible contaminants, such as solvents and other hydrocarbon based substances, employing a single regenerative bed is disclosed in U.S. Pat. No. 4,741,690. In the process presented therein, the contaminated process exhaust stream is passed through a single heated bed of heat absorbent material having heat-accumulating and heat-exchanging properties, such as sand or stone, to raise the temperature of the contaminated process exhaust stream to the temperature at which combustion of the contaminants occurs, typically to a peak preheat temperature of about 900° C., so as to initiate oxidization of the contaminants to produce carbon-dioxide and water. At a periodic timed interval, typically of from about 90 to 120 seconds, the direction of flow of the process exhaust stream through the bed is reversed. As the contaminants combust within the center of the bed, the temperature of the process exhaust stream raises. As the heated exhaust stream leaves the bed, it loses heat to the heat-accumulating material making up the bed and is cooled to a temperature about 20° C. to 25° C. above the temperature at which it entered the other side of bed. By reversing the direction of the flow through the bed, the incoming contaminated process exhaust stream is preheated as it passes that portion of the bed which has just previously in time been traversed by the post-combustion, hot process exhaust stream, thereby raising the temperature of the incoming process exhaust stream to the point of combustion by the time the incoming process exhaust stream reaches the central portion of the bed.

In the regenerative bed heat exchanger apparatus disclosed in U.S. Pat. No. 4,741,690, a heating means, typically an electric resistance heating coil disposed in the central portion of the bed, is provided to initially preheat the central portion of the bed to a desired temperature at which combustion of the contaminants in the process exhaust stream would be self-sustaining. Once steady state equilibrium conditions are reached, the electric resistance heating coil may usually be deactivated as the incoming process exhaust stream is adequately preheated and combustion is self-sustaining due to the gas switching procedure hereinbefore described.

In such a single bed system, it is necessary to reverse the direction of flow of the process exhaust gases through the bed in order to maintain a proper temperature profile within the bed. Optimally, the temperature profile within the bed should be maintained such that the central portion of the bed is the hottest while the bed is the coolest at its upstream and downstream edges. If the direction of flow of the process exhaust gases through the bed is not properly switched, this optimum temperature profile will be destroyed. If the interval between switching is too long, the peak temperature zone within the bed is widened and migrates toward the downstream edge of the bed which results in a decrease in the heat exchange efficiency of the downstream portion of the bed thereby resulting in an unacceptable increase to the temperature of the cooled incinerated process exhaust gases vented from the regenerative bed incinerator system. On the other hand, if the interval between switching is too short, the hydrocarbon destruction efficiency will decrease.

Accordingly, it is an objective of the present invention to provide a method and apparatus for switching the direction of flow of the process exhaust gases through the bed at a selective interval, rather than a constant time interval, so as to optimize overall incinerator ator performance and maintain an optimal temperature within the bed.

SUMMARY OF THE INVENTION

The present invention provides an improved regenerative bed incinerator system and method of operating same wherein the switching of the direction of flow of process exhaust gases is carried out at untimed intervals and in such manner so as to maintain a temperature profile within the bed wherein the peak temperatures are maintained within the central portion of the bed and the coolest temperatures are maintained at the leading and trailing edges of the bed.

The regenerative bed incinerator system of the present invention comprises incinerator means having at least one gas permeable bed of particulate material having heat-accumulating and heat-exchanging properties for receiving a contaminated process exhaust gas, thence preheating the contaminated process gases, thence incinerating the combustible contaminants therein, and thence cooling the incinerated process exhaust stream; gas flow directing means operatively associated with the incinerator means for receiving the contaminated process exhaust stream, thence alternately directing the contaminated process exhaust stream to and through the incinerator means in opposite, alternate directions so as to periodically reverse the direction of gas flow the incinerator means, and also for receiving the cooled incinerated process exhaust gases from the incinerator means and thence discharging the cooled incinerated process exhaust gases; a supply duct connected in flow communication with the gas flow directing means for supplying a flow of contaminated process exhaust gas thereto; a vent duct connected in flow communication with the gas flow directing means for exhausting the cooled incinerated process exhaust stream therefrom; and control means operatively associated with the gas flow directing means for selectively activating the gas flow directing means in response to the temperature of the cooled incinerated process exhaust stream.

The present invention provides an improved regenerative bed incinerator system adapted to improve hydrocarbon destruction efficiency by recirculating a portion of the incinerated process exhaust gases discharging from the regenerative bed incinerator through the combustion portion of the bed again so as to incinerate any contaminants which might have escaped complete incineration on the first pass therethrough and, consequently, were not totally reduced to carbon dioxide and water. A control system is provided which permits the flow to the regenerative bed incinerator of both incoming contaminated process exhaust gases and the total flow gases, that is the overflow flow of incoming contaminated process exhaust gases, recycled incinerated process exhaust gases and tempering air, if any, to be maintained relatively constant.

BRIEF DESCRIPTION OF THE DRAWING

The present invention will be better understood as described in greater detail hereinafter with reference to the sole figure of drawing which illustrates schematically a regenerative bed incinerator apparatus incorporating control means for selectively reversing the direction of flow of process exhaust gas through the bed in accordance with the present invention.

DESCRIPTION OF A PREFERRED EMBODIMENT

Referring now to the drawing, there is depicted therein a regenerative bed incinerator 10 incorporating control means for selectively reversing the direction of flow of process exhaust gas through the bed. It is to be understood that the term process exhaust gases as used herein refers to any process off-stream, be it waste gas or exhaust air, which is contaminated with combustible fumes of an environmentally objectionable nature including, without limitation, solvents, gasoline vapors, paint fumes, chlorinated hydrocarbons and other hydrocarbon substances, and which bears sufficient oxygen, in and of itself or through the addition of air thereto, to support combustion of the contaminants.

The regenerative bed incinerator 10 comprises a housing 12 enclosing a bed 14 of heat accumulating and heat transfer material, a lower gas plenum 16 disposed subadjacent the bed 14, and an upper gas plenum 18 disposed superadjacent the bed 14. Both the lower gas plenum 16 and the upper gas plenum 18 are provided with a gas flow aperture opening 20 and 20', respectively, which alternately serve as gas flow inlets or outlets depending upon the direction of gas flow through the bed, which as will be discussed further hereinafter is periodically reversed.

The bed 14 is comprised of particulate, heat-accumulating and heat-transfer material, such as sand or stone or other commercially available ceramic or metallic material which has the ability to absorb, store and exchange heat and which is sufficiently heat resistant so as to withstand without deterioration the combustion temperatures experienced within the bed. The particulate bed material is loosely packed within the bed 14 to provide sufficient void space within the bed volume such that the process exhaust gases may freely flow therethrough in either direction via a multiplicity of random and tortuous flow paths so that sufficient gas/-material contact is provided to ensure good heat transfer. The particular size of the bed material and gas flow velocity (i.e., pressure drop) through the bed is somewhat application dependent and will vary from case to case. Generally, the bed material will be greater than about two millimeters in its minimum dimension. The gas flow velocity through the bed 14 is to be maintained low enough to preclude fluidization of the particulate bed material.

Preferably, heating means 22, such as an electric resistance heating coil, is embedded within the central portion of the bed 14. The heating means 22 is selectively energized to preheat the material in the central portion of the bed 14 to a temperature sufficient to initiate and sustain combustion of the contaminants in the process exhaust gases, typically to a temperature of about 900° C. Once steady-state, self-sustaining combustion of the contaminants is attained, the heating means 22 is deactivated. Although not generally necessary, the heating means 22 may be periodically reactivated, or even continuously activated at a low level, to provide supplemental heat to the bed 14 to ensure self-sustaining combustion of the contaminants.

Both of the lower and upper gas plenums 16 and 18 are connected in flow communication to valve means 30 which is adapted to receive through the supply duct 40 from the fan 50 incoming process exhaust gases 3 to be incinerated at the first port 32 thereof and selectively direct the received process exhaust gases 3 through either the gas duct 60 which connects the opening 20 of the lower gas plenum 16 in flow communication to the second part 34 of the valve means 30 or the gas duct 60' which connects the opening 20' of the upper gas plenum 18 in flow communication to the third port 36 of the valve means 30. The fourth port 38 of the valve means 30 is connected to the exhaust duct 70 through which the incinerated process gas stream 5 is vented to the atmosphere.

At spaced intervals valve means 30 is actuated by controller 80 to reverse the flow of gases through the bed 14. Thus, the role of the lower and upper gas plenums 16 and 18 is reversed with one going from serving as an inlet plenum to serving as an outlet plenum for the incinerator 10, while the other goes from serving as an outlet plenum to serving as an inlet plenum for the incinerator 10. A few minutes later, their role is again reversed. In this manner, the upper and lower portions of the bed alternately absorb heat from the incinerated process exhaust gases leaving the central portion of the bed wherein most of the combustion of the contaminants occurs, and thence give up that recovered heat to incoming process exhaust gases being passed to the bed 14 for incineration.

With the valve means 30 in position A, the incoming process exhaust gases 3 to be incinerated are directed through the first port 32 of the valve means 30 to the second port 34 thereof, thence through gas duct 60 to the lower gas plenum 16 to pass upwardly therefrom through the lower portion of the bed 14 wherein the process exhaust gases are preheated, thence through the central portion of the bed 14 wherein the contaminants therein are incinerated, thence through the upper portion of the bed 14 wherein the incinerated process exhaust gases are cooled by transferring heat to the bed material in the upper portion of the bed, and thence passes into the upper gas plenum 18. The incinerated process exhaust gases 5 are thence passed therefrom through the gas duct 60' to the third port 36 of the valve means 30 and is thence directed through the fourth port 38 of the valve means 30 to the exhaust duct 70 for venting to the atmosphere.

With the valve means 30 in position B, the incoming process exhaust gases 3 to be incinerated are directed through the first port 32 of the valve means 30 to the third port 36 thereof, thence through gas duct 60' to the upper gas plenum 18 to pass downwardly therefrom through the upper portion of the bed 14 wherein the process exhaust gases are preheated, thence through the central portion of the bed 14 wherein the contaminants therein are incinerated, thence through the lower portion of the bed 14 wherein the incinerated process exhaust gases are cooled by transferring heat to the bed material in the lower portion of the bed, and thence passes into the lower gas plenum 16. The incinerated process exhaust gases 5 are thence passed therefrom through the gas duct 60 to the second port 34 of the valve means 30 and is thence directed through the fourth port 38 of the valve means 30 to the exhaust duct 70 for venting to the atmosphere.

As noted hereinbefore, it is necessary to reverse the direction of flow of the process exhaust gases through the bed 14 in order to maintain a proper temperature profile within the bed 14. Optimally, the temperature profile within the bed 14 should be maintained such that the central portion of the bed 14 is the hottest while the bed 14 is the coolest at its upstream and downstream edges. If the direction of the flow of the process exhaust gases through the bed 14 is not properly switched, the optimum temperature profile will be destroyed. Rather than merely activating the gas switching means 30 at timed intervals as in the prior art to reverse the direction of flow of the process exhaust gases through the bed 14, controller means 80 is provided in operative association with the gas switching means 30 for selectively activating the gas switching valve means 30 in response to the temperature of the exhausted cooled incinerated process exhaust gases 5.

To this end, a temperature sensing means 90, such as a thermocouple, is disposed in the exhaust gas duct 70 at a location downstream of the gas switching valve means 30 for measuring the temperature of the cooled incinerated process exhaust gas 5 passing through the exhaust duct 70. The temperature sensing means 90 generates a temperature signal 95 which is indicative of the temperature of the cooled incinerated process exhaust gas leaving the downstream portion of the bed 14 and transmits the temperature signal 95 to the controller means 80.

The controller means 80, which most advantageously comprises a programmable logic controller, continuously receives the temperature signal 95 from the temperature sensing means 90 and establishes a set point temperature which is representative of the sensed temperature of the exhausted cooled incinerated process exhaust stream 5 shortly after, typically about five seconds after, the last reversal in the direction of flow of process exhaust gases through the bed 14.

Thereafter, the controller means 80 continuously monitors the temperature signal 95 and continuously compares the sensed temperature to the previously established set point temperature and determines the difference between the sensed temperature of the incinerated process exhaust gases 5 and the set point temperature which is representative of the sensed temperature of the exhausted incinerated process exhaust gases shortly after the last flow reversal. Of course, as operation of the regenerative bed incinerator 10 continues after the last flow reversal, the temperature of the incinerated process exhaust gases 5 gradually increases. This gradual increase in the temperature of the incinerated process exhaust gases 5 results from an expansion of the peak temperature zone within the bed 14 from the center of the bed 14 toward the downstream edge of bed 14.

In accordance with the present invention, the controller means 80 monitors the determined temperature differential between the sensed temperature of the incinerated process exhaust gases 5 at a given instance and the set point temperature representative of the sensed temperature of the incinerated process exhaust gases shortly after the last reversal, and uses this temperature difference as the control parameter upon which it activates the gas flow switching valve means 30 as a means of ensuring that the temperature profile within the bed 14 does not depart too far from the optimum temperature profile. Whenever the temperature differential determined by the controller means 80 reaches a preselected upper limit of permissible temperature differential, typically ranging from about 10° C. to about 25° C., the controller means 80 activates the gas flow switching valve means 30 to switch from position A to position B, or from position B to position A, thereby reversing the direction of the flow of process exhaust gases 3 through the regenerative bed incinerator 10. Shortly the reversal of gas flow is accomplished, the controller means resets the set point temperature, and temperature monitoring procedure outlined herein is repeated.

In this manner, an optimal switch time is maintained since the temperature of the incinerated process exhaust gases 5 is never allowed to increase greatly above its initial valve after a reversal in flow direction takes place. Thus a near optimal temperature profile is maintained within the bed 14 of the regenerative bed incinerator 10 thereby ensuring that high heat exchange efficiency and high hydrocarbon destruction efficiency are maintained.

We claim:

1. A method of operating a regenerative gas permeable bed incinerator system for treating a process exhaust stream having a combustible contaminants therein so as to incinerate said contaminants, comprising:

a. passing the contaminated process exhaust stream to be treated through a gas permeable bed of heated particulate material having heat-accumulating and heat-exchanging properties thereby preheating the contaminated process exhaust stream and cooling the first bed;

b. combusting the preheated contaminated process exhaust stream so as t incinerate a substantial portion of the combustible contaminants therein;

c. passing the incinerated process exhaust stream to be treated through a gas permeable bed of cool particulate material having heat-accumulating and heat-exchanging properties thereby cooling the incinerated process exhaust stream and preheating the second bed;

d. exhausting the cooled incinerated process exhaust stream discharging from the gas cooling bed;

e. selectively reversing the direction of flow of process exhaust gases through said regenerative bed incinerator system at spaced time intervals, said step of selectively reversing the direction of flow comprising the substeps of:

continuously sensing the temperature of the exhausted cooled incinerated process exhaust stream; establishing a set point representative of the sensed temperature of the exhausted cooled incinerated process exhaust stream shortly after each reversal in the direction of flow of process exhaust gases through said regenerative bed incinerator system; thereafter continuously comparing the sensed temperature of the exhausted cooled incinerated process exhaust stream to the set point and determining the difference therebetween; and whenever said determined temperature difference exceeds a preselected upper limit of desired temperature differential reversing the direction of flow of process exhaust gases through said regenerative bed incinerator system.

2. A method of operating a regenerative gas permeable bed incinerator system as recited in claim 1 wherein the preselected upper limit of desired temperature differential lies in range from about 10° C. to about 25° C.

3. A regenerative gas permeable bed incinerator system for treating a process exhaust stream having combustible contaminants therein so as to incinerate said contaminants, comprising:

a. incinerator means for receiving the contaminated process exhaust stream, preheating the contaminated process exhaust stream, cooling the incinerated process exhaust stream, and discharging the cooled incinerated process exhaust stream, said incinerator means having at least one gas permeable bed of particulate material having heat-accumulating and heat-exchanging properties disposed therein;

b. gas flow directing means operatively associated with said incinerator means for receiving the contaminated process exhaust stream and alternately directing the contaminated process exhaust stream to and through said incinerator means in opposite, alternate directions so as to periodically reverse the direction of gas flow through said incinerator means, and for receiving the cooled incinerated process exhaust stream from said incinerator means and thence discharging the cooled incinerated process exhaust stream;

c. a process exhaust stream supply duct connected in flow communication with said gas flow direction mean for supplying a flow of contaminated process exhaust gas thereto;

d. a process exhaust stream vent duct connected in flow communication with said gas flow directing means for exhausting the cooled incinerated process exhaust stream discharging from said gas flow directing means; and e. control means operatively associated with said gas flow directing means for activating said gas flow directing means in response to the temperature of the cooled incinerated process exhaust stream, said control means for activating said gas flow directing means comprising:

1. temperature sensing means disposed in said process exhaust stream vent duct at a location downstream with respect to gas flow of said gas flow directing means for measuring the temperature of the cooled incinerated process exhaust stream passing therethrough and generating a signal indicative of said measured gas temperature; and 2. controller means for receiving the signal indicative of said measured gas temperature from said gas temperature sensing means, comparing said signal to a set point value of temperature and determining the difference therebetween, and generating and transmitting a control signal to said gas flow directing means whenever said determined temperature difference exceeds a preselected upper limit of desired temperature differential to activate said gas flow directing means so as to reverse the direction of flow of process exhaust gases through said regenerative bed incinerator system.

* * * * *